US005491998A

United States Patent [19]

Hansen

[11] Patent Number: 5,491,998

[45] Date of Patent: Feb. 20, 1996

[54] METHOD OF MAKING A LEAF REJECTING RAIN GUTTER

[76] Inventor: Harry Hansen, 148 Livingston Ave., Babylon, N.Y. 11702

[21] Appl. No.: 377,491

[22] Filed: Jan. 24, 1995

Related U.S. Application Data

[63] Continuation of Ser. No. 74,057, Jun. 9, 1993, abandoned.

[51] Int. Cl.[6] ..... B21D 51/16; F04D 13/076

[52] U.S. Cl. ..... 72/181; 72/178; 52/12

[58] Field of Search ..... 72/181, 179, 178, 72/182; 52/12, 11

[56] References Cited

U.S. PATENT DOCUMENTS

| | | | |
|---|---|---|---|
| 891,405 | 6/1908 | Cassens | 52/12 |
| 2,826,235 | 3/1958 | Gudmestad | 72/181 |
| 2,873,700 | 2/1959 | Heier | 52/12 |
| 3,950,951 | 4/1976 | Zukauskas | 52/12 |
| 4,604,837 | 8/1986 | Beam | 52/12 |
| 4,667,448 | 5/1987 | Smith | 52/12 |
| 4,727,689 | 3/1988 | Bosler | 52/12 |
| 4,757,649 | 7/1988 | Vahldieck | 52/12 |
| 4,765,101 | 8/1988 | Wolf | 52/12 |
| 4,858,396 | 8/1989 | Rose | 52/12 |
| 4,899,566 | 2/1990 | Knudson | 72/181 |
| 4,912,888 | 4/1990 | Martin | 52/12 |

FOREIGN PATENT DOCUMENTS

| | | | |
|---|---|---|---|
| 183299 | 9/1955 | Austria | 72/178 |
| 644352 | 7/1962 | Canada | 52/11 |
| 515190 | 11/1992 | European Pat. Off. | 72/181 |

*Primary Examiner*—Daniel C. Crane
*Attorney, Agent, or Firm*—Collard & Roe

[57] ABSTRACT

An improved elongated gutter system for mounting under the edge of a roof of a structure for receiving water run-off in preference to leaves and debris. The gutter system includes a back support wall having a top and a bottom for mounting against a wall of the structure. A trough is joined to the bottom of the back support wall. A shield is joined with the top of the back support wall and has a free front end. The shield forms a continuous surface that extends from the back support wall and turns inward over the trough before ending, so that rain, leaves and debris move downward over said shield with the rain entering the trough and the leaves and debris passing beyond the trough. The improvement resides in a reinforcing fold-over edge on the free front end of the shield, wherein the fold-over edge is generally parallel to the trough.

5 Claims, 2 Drawing Sheets

METHOD OF MAKING A LEAF REJECTING RAIN GUTTER

CROSS-REFERENCE TO RELATED APPLICATION

This is a continuation of my application Ser. No., 08/074,057, filed Jun. 9, 1993, now abandoned.

BACKGROUND OF THE INVENTION

1. Field of the Invention

The invention relates to a leaf rejecting rain gutter for collecting rain water. More particularly, it relates to a leaf rejecting gutter that has a reinforced edge on the leaf shield.

2. The Prior Art

The need to collect run-off rain water from roofs and direct it away from a buildings foundation has been long recognized. There have been numerous attempts at providing gutter systems where a shield is placed over part of the gutter to avoid having leaves and debris enter the gutter.

One such attempt is set forth in U.S. Pat. No. 4,757,649 to Vahldieck. The Vahldieck patent discloses a leaf rejecting rain gutter in which the shield is formed as a continuous double curved convolute curve, generated on two different radii. However, the Vahldieck rain gutter has a deficiency, in that the lower free end of the shield is rippled or stretched. This ripple is created as a result of cutting forces or tensile forces on the edge as the sheet material which forms the gutter is cut to size or molded into shape. Since the lower free edge of the shield is in close relation to the gutter trough, the rippledge is quite noticeable. The appearance detracts from the esthetics of the structure on which the gutter is mounted. Accordingly, it would be advantageous to have a leaf rejecting rain gutter where the lower edge of the shield was generally parallel to the trough.

SUMMARY OF THE INVENTION

It is therefore an object of the present invention to provide a leaf rejecting rain gutter which overcomes the drawbacks of the prior art and has a leaf shield that is generally parallel to the trough.

It is a further object of the present invention to provide a leaf rejecting rain gutter which has a uniform appearance and will not detract from the aesthetics of the structure on which it is mounted.

It is a further object of the present invention to provide a leaf rejecting rain gutter in which the lower edge of the shield includes a reinforcing fold-over edge.

These and other related objects are achieved according to the invention by an improved elongated gutter system for mounting under the edge of a roof of a structure for receiving water run-off in preference to leaves and debris. The gutter system includes a back support wall having a top and a bottom, for mounting against a wall of a structure. A trough is joined to the bottom of the back support wall. A shield having a back end is joined with the top of the back support wall and includes a free front end. The shield forms a continuous surface that extends from the back support wall and turns inward over the trough before ending. Rain, leaves and debris move downward over the shield with the rain entering the trough and the leaves and debris passing beyond the trough. The improvement comprises a reinforcing fold-over edge on the free front end of the shield, wherein the fold-over edge is generally parallel to the trough.

The shield may be shaped as a double-curved convoluted surface. The back support wall, the trough and the shield are integrally formed from a flat sheet of material. The fold-over edge and the trough define the sides of a longitudinally extending gutter opening. The width of the gutter opening is measured perpendicular to longitudinal direction and the width is generally uniform across the length of the gutter opening. The material is aluminum, for example.

The invention also contemplates an apparatus for forming an elongated gutter system from a flat sheet of material having a first longitudinally-extending edge and a second longitudinally-extending edge. A first set of correspondingly-shaped rollers forms a curve along the first longitudinal edge of the sheet material. A second set of correspondingly-shaped rollers folds the first longitudinally-extending curved edge back toward the second longitudinally-extending end. A third set of rollers presses the first longitudinally-extending folded edge flat against the sheet material to form a double layered, straight, fold-over edge. The apparatus further includes means for molding a shield adjacent the first double layered edge, a trough adjacent the second longitudinally-extending edge, and a back support wall between the shield and the trough.

The invention further encompasses a method of making a gutter system from a flat sheet of material having a first longitudinally-extending edge and a second longitudinally-extending edge for mounting under the edge of a roof of a structure for receiving water run-off in preference to leaves and debris. A reinforcing fold-over edge is formed along the first longitudinally-extending edge. A shield is formed adjacent to the first reinforced edge, a trough is formed adjacent the second longitudinally-extending edge and a back support wall is formed between the shield and the trough. The reinforcing fold-over edge is formed by creating a curve along the first longitudinally-extending edge, folding the curved edge back toward the second longitudinally-extending edge and pressing the folded edge flat against the sheet material to form a double layered straight fold-over edge. The flat sheet of material is aluminum.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
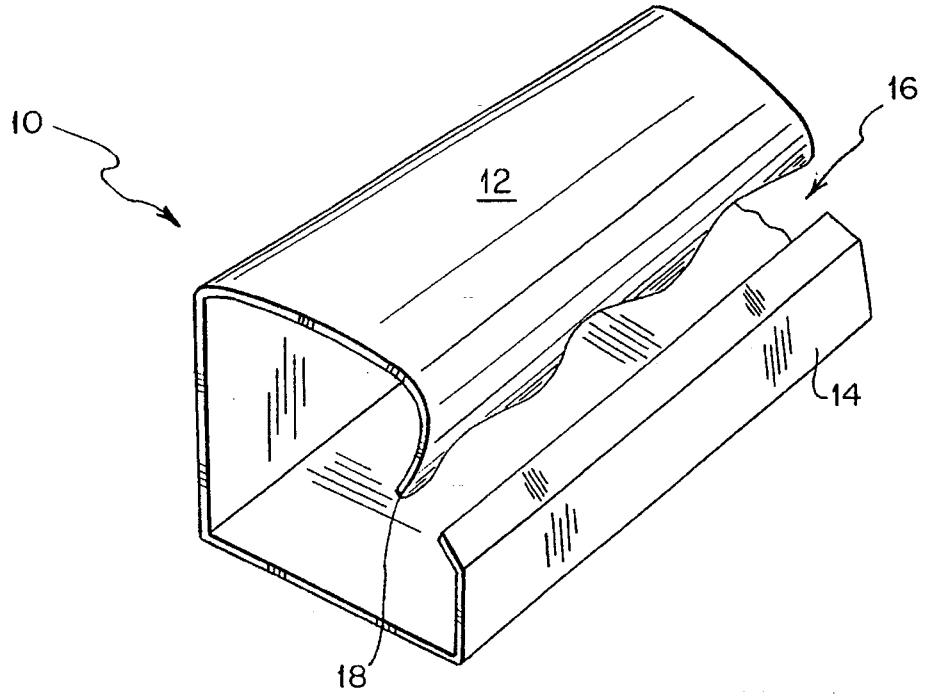
FIG. 1 (PRIOR ART)
FIG. 1 is a perspective view of a leaf rejecting rain gutter according to the prior art.

Referring now to the drawings and in particular FIG. 1, there is shown a prior art leaf rejecting rain gutter 10 according to U.S. Pat. No. 4,757,649, which is incorporated herein by reference. Leaf rejecting rain gutter 10 has a leaf shield 12, a trough 14 and an opening 16 between shield 12 and trough 14. Shield 12 has a lower free end 18 that defines the upper edge of opening 16. When gutter 10 is formed from a flat sheet of material, excess material may be cut from edge 18. Subsequently, shield 12 is formed from the flat sheet of material. During the cutting and forming operations, edge 18 is subjected to tensile forces that tend to stretch the material along edge 18. The stretched edge 18 then becomes rippled. Since opening 16 is relatively narrow and edge 18 is closely positioned relative to the upper edge of trough 14, the rippled edge is quite apparent and is visually unappealing.

Figure 2:
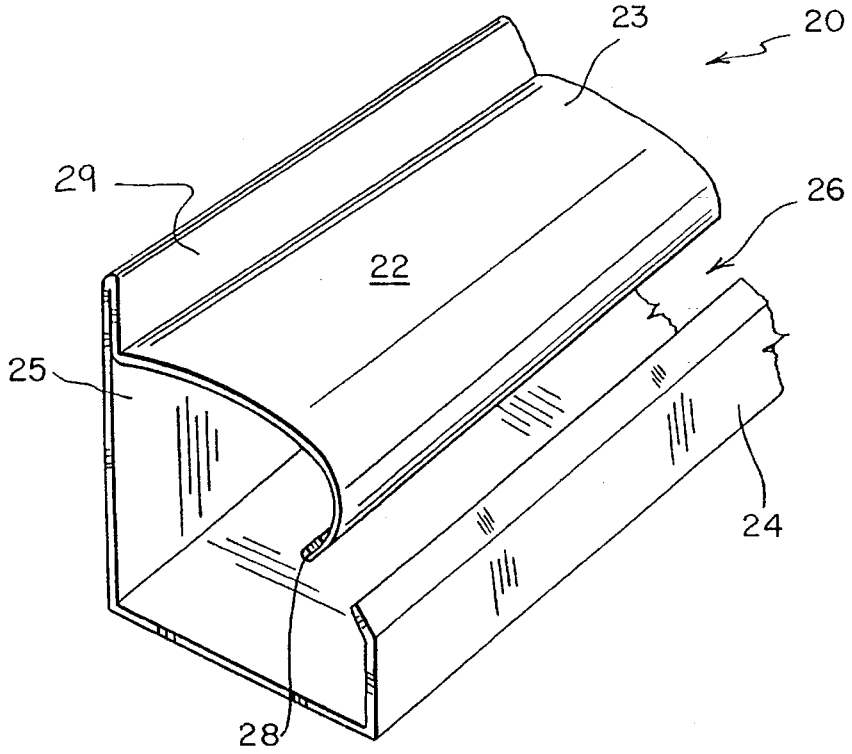
FIG. 2 is a perspective view of an embodiment of a leaf rejecting rain gutter according to the invention.

As can be seen in FIG. 2, there is shown an embodiment of a leaf rejecting rain gutter 20, according to the invention, having a shield 22, a trough 24, and an opening 26 between shield 22 and trough 24. A back wall 25 is integrally formed with trough 24 and a back end 23 of shield 22. The lower section of shield 22 includes a first reinforcing fold-over edge 28 adjacent opening 26. Surprisingly, it was discovered that double-layer fold-over edge 28 strengthens the lower part of shield 22 so that the edges defining opening 26 are generally straight and parallel to each other. A second reinforcing fold-over edge 29 is formed where back wall 25 meets shield 22.

As can be seen in FIG. 3, there is shown a section of sheet material 32 having an edge 33*a*, that will be molded to form gutter 20. Sheet material 32 is sheet aluminum that is sold in several hundred foot rolls, for example. Sheet material 32 is fed through a housing in a downstream direction. A series of motor-driven rollers frictionally feed sheet material 32 through the housing where it is formed into a finished gutter system.

Figure 3A:
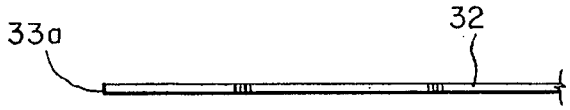
FIG. 3*a* is a front side elevational view of a flat sheet of material to be formed into the leaf rejecting rain gutter.
Figure 3B:
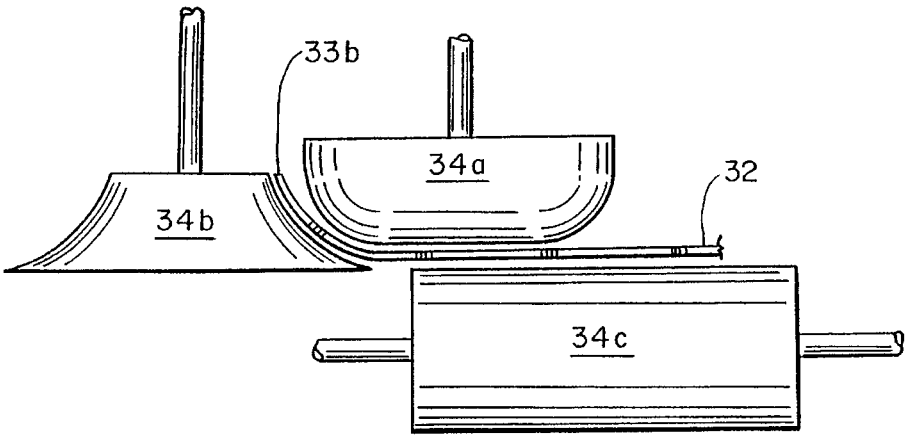
FIG. 3*b* is a side elevational view of a first set of rollers forming a gentle curve in the flat sheet of material.
Figure 3D:
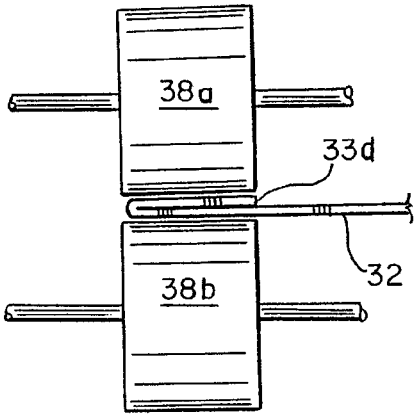
FIG. 3*d* is a side elevational view of a third set of rollers forming the reinforcing fold-over edge of the leaf rejecting rain gutter.
Figure 3C:
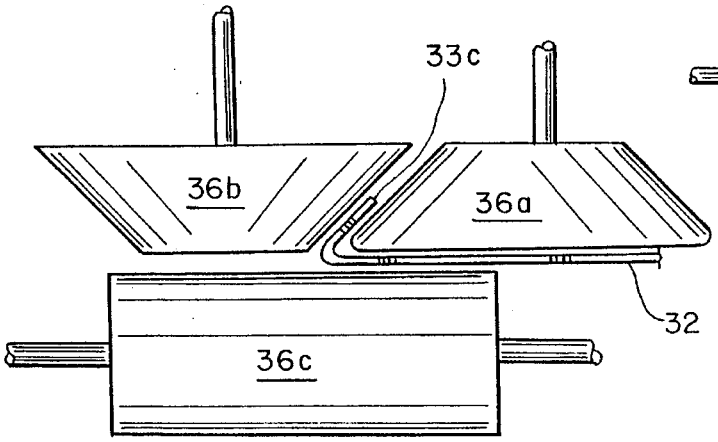
FIG. 3*c* is a side elevational view of a second set of rollers forming a fold in the flat sheet of material.

As can be seen in FIG. 3*b*, a first set of rollers including correspondingly shaped rollers 34*a* and 34*b* and a lower roller 34*c* forms a gentle curve onto edge 33*b* of sheet material 32. Referring now to FIG. 3*c*, there is shown a second set of rollers, downstream from rollers 34, including correspondingly shaped rollers 36*a* and 36*b* and a lower roller 36*c*. The second set of rollers 36 imparts a fold to edge 33*c* of sheet material 32. As can be seen in FIG. 3*d*, there is shown a third set of rollers 38, downstream from rollers 36, including an upper roller 38*a* and a lower roller 38*b*. The third set of rollers 38 act on the folded edge 33*c* to press it flat against sheet material 32. The double-layered folded edge 33*d* is substantially straight. Following creation of the fold-over edge, a series of dies form the shield adjacent the fold-over edge, a trough adjacent the opposite edge and a back support wall between the shield and the trough.

Surprisingly, it was discovered that the sheet aluminum could not be provided with the double-layered folded edge from the factory. That is because, once the double-layered folded edge is created, the material can no longer be wound into rolls. Accordingly, the double-layered folded edge must be formed just prior to the creation of the shield, back wall and trough. The gutter system, the apparatus for forming the gutter system and the method of making a gutter system as set forth below, all relate to forming the reinforcing foldover edge as the material comes off the roll before the shield, back wall and trough are formed.

While only a single embodiment of the present invention has been shown and described, it is to be understood that many changes and modifications may be made thereunto without departing from the spirit and scope of the invention as defined in the appended claims.

What is claimed is:

1. A method of making an integrally-formed gutter system from a flat sheet of material having a first longitudinally-extending edge and a second longitudinally-extending edge for mounting under the edge of a roof of a structure, said gutter system including a trough partially covered by a shield for receiving water run-off in preference to leaves and debris, the method comprising the steps of:

forming a first reinforcing fold-over edge along said first longitudinally-extending edge of said flat sheet of material;

forming a shield adjacent the first reinforcing fold-over edge;

forming a trough having a front wall adjacent the second longitudinally-extending edge of said flat sheet of material; and forming a back support wall between said shield and said trough to include a second reinforcing fold-over edge, between said back support wall and said shield, adapted to contact the structure;

wherein said shield comprises a continuous, double-curved convolute, the curve of which extends from said back support wall, said double curve being generated upon a (i) first radius having its origin at the location where said trough joins said back support wall; and (ii) a second radius having a length between one-eighth and one-quarter the length of said first radius; said curves joining at a location where each is tangent to a common line;

wherein said first reinforcing fold-over edge is spaced from the back support wall and closely positioned to said trough front wall; said first reinforcing fold-over edge and said trough front wall being straight and parallel to each other to provide an aesthetically pleasing appearance.

2. The method according to claim 1, wherein said step of forming a reinforcing fold-over edge comprises:

creating a curve along the first longitudinally-extending edge;

folding said curved edge back toward said second longitudinally-extending edge; and pressing said folded edge flat against the sheet material to form a double-layered straight fold-over edge.

3. The method according to claim 2, wherein said flat sheet of material is aluminum.

4. The method according to claim 3, wherein said shield extends between 90 and 100 percent of the distance from said back support wall to said front wall.

5. The method according to claim 4, wherein said front wall has a height between one-eighth and one-quarter the length of said first radius.

* * * * *